United States Patent [19]

Flavigny

[11] Patent Number: 4,645,276

[45] Date of Patent: Feb. 24, 1987

[54] ANGLE IRON FOR SUPPORTING PLATES, PANELS OR OTHER OBJECTS AND CABINET FORMED USING ANGLE IRONS OF THIS TYPE

[75] Inventor: Jean-Pierre Flavigny, Linas, France

[73] Assignee: Facom, Morangis, France

[21] Appl. No.: 762,831

[22] Filed: Aug. 6, 1985

[30] Foreign Application Priority Data

Aug. 8, 1984 [FR] France ..... 84 12569

[51] Int. Cl.[4] ..... A47B 43/00

[52] U.S. Cl. ..... 312/257 SK; 108/107; 312/257 A; 312/257 SM

[58] Field of Search ..... 248/224.4; 108/111, 108/107; 312/257 SK, 257 SM, 257 A, 257 R

[56] References Cited

U.S. PATENT DOCUMENTS

| | | | |
|---|---|---|---|
| 4,258,631 | 3/1981 | Brown | 108/91 |
| 4,368,936 | 1/1983 | Worrallo | 312/257 SK |
| 4,556,148 | 12/1985 | Koller | 108/111 |

FOREIGN PATENT DOCUMENTS

| | | | |
|---|---|---|---|
| 810181 | 8/1951 | Fed. Rep. of Germany . | |
| 2724636 | 7/1978 | Fed. Rep. of Germany | 312/257 SK |
| 1294322 | 4/1961 | France . | |
| 294322 | 4/1962 | France . | |
| 570503 | 7/1945 | United Kingdom . | |
| 695180 | 8/1953 | United Kingdom | 312/257 SK |
| 826200 | 12/1959 | United Kingdom | 312/257 SK |
| 2121676 | 1/1984 | United Kingdom | 312/257 SK |

*Primary Examiner*—James T. McCall

*Attorney, Agent, or Firm*—Wenderoth, Lind & Ponack

[57] ABSTRACT

This angle iron is shaped so that the lateral section of each of its flanges is folded inwards (25, 26) and has holes (12) located at intervals along this folded-back section so that devices (50) for fixing a bracket (48) or a plate (40) cannot be seen from the outside. The angle iron is also curved inwards so as to form a flat surface (34) in the same plane as the folded-back section or slightly offset in relation to the latter, and other holes (36) are provided in this surface (34), thereby enabling additional external or internal elements to be supported and providing a recess for the fixing devices.

12 Claims, 12 Drawing Figures

ANGLE IRON FOR SUPPORTING PLATES, PANELS OR OTHER OBJECTS AND CABINET FORMED USING ANGLE IRONS OF THIS TYPE

Nowadays angle irons provided with holes are commonly used to support shelves, plates or similar objects and to form, as a result, storage cabinets which can be disassembled and adapted. These angle irons have on each of their flanges a series of holes which are located at regular intervals along their length and through which fixing devices can pass. Therefore, the elements to be supported can be mounted with extreme ease and the fixing devices are readily accessible for the purposes of disassembly or other operations. Unfortunately, the fixing devices project from the surface of the angle iron and therefore constitute a certain danger during use.

The object of the present invention is to overcome these drawbacks by designing a supporting angle iron which, while allowing an extremely wide variety of fixing devices to be easily fitted and removed, eliminates the danger of people getting caught on them.

In fact, this invention relates to a supporting angle iron which is shaped and has a flat middle part between two flanges which are curved at two points in opposite directions and with each end in a flat section which is folded inwards and provided with holes.

The angle iron therefore has, in each flange, two parallel surfaces with holes, which are inset in relation to its external surface.

It is therefore able to support simultaneously, on the one hand, the parts engaged in the folded-back section of its internal surface and protected by the opposite surface and, on the other hand, external parts fixed in the holes of the inset second flat surface.

The invention also relates to cabinets or similar objects, the vertical members of which consist of angle irons which support at least one plate fixed directly to these angle irons or by means of angle support brackets engaged simultaneously in holes in the two flanges.

Such a cabinet can also accommodate shelves, baskets or other external parts.

The advantages and characteristic features of the invention will emerge more clearly from the following description of embodiments given by way of non-limiting examples and illustrated in the attached drawings in which.

Figure 1:
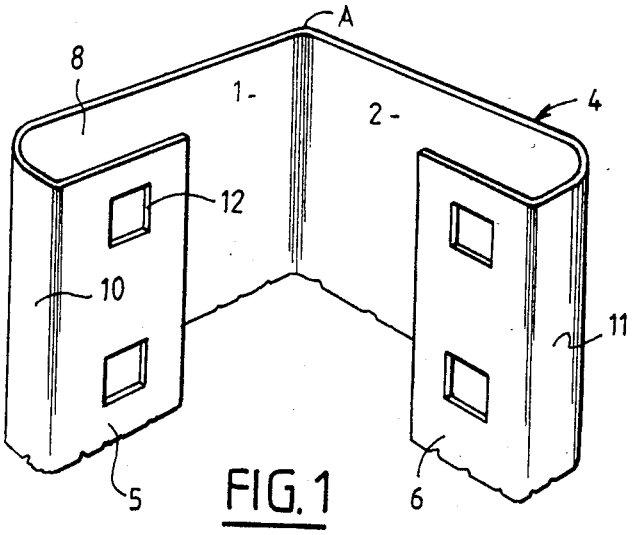
FIG. 1 is a partial, perspective view of an angle iron for supporting plates or other objects according to the invention.

As shown in the drawings, in particular FIGS. 1 to 5, the two flanges 1 and 2 of an angle iron 4 intended to support plates, shelves, baskets or other objects are bent and folded inwards so as to form a wall 5, 6 substantially parallel to the initial general direction of the corresponding flange 1 or 2. The wall 5 or 6 thus defines with the corresponding flange 1 or 2 a space or recess 8 closed on one side by a wall 10 or 11 and open in the direction of the point where the two flanges of the angle iron are joined together. Moreover, each of the walls 5 and 6 has a series of holes 12 located at intervals along its length.

Figure 2:
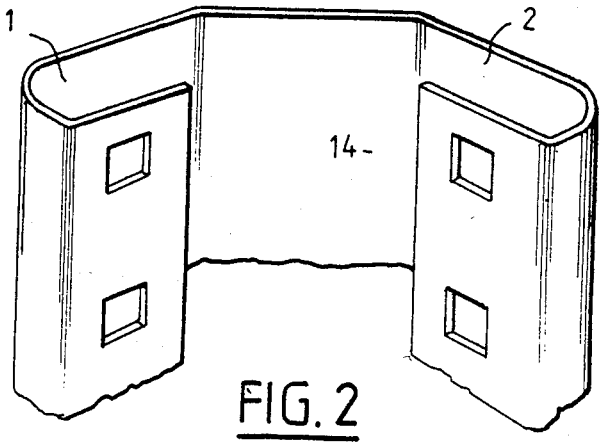
FIGS. 2 to 5 are views, similar to those in FIG. 1, of variations in embodiment of the angle iron.
Figure 3:
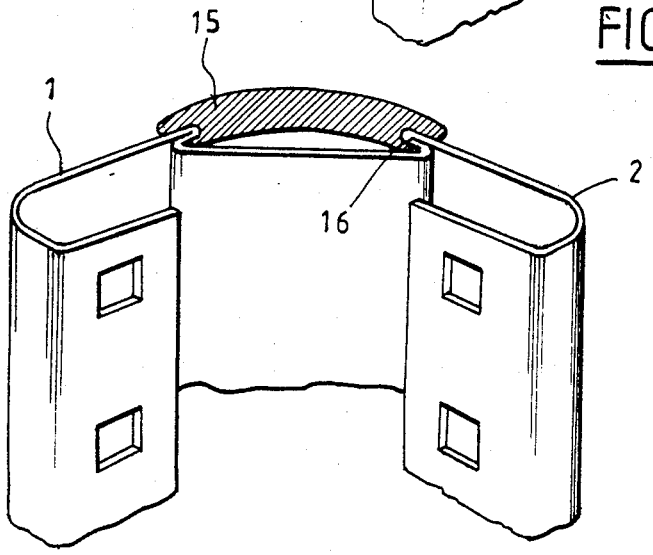

The holes 12 may have a square shape, as shown in FIGS. 1 to 3, or any other suitable shape for receiving clips, bolts, hooks or other devices for fixing a plate, a bracket or another support part. They may even be round in shape and integral with a nut fixed inside the recess 8. Whatever type of device is used, their fastening end is accommodated in the space 8. Consequently, not only will it be invisible from the outside, but there will be no projection on the external surface of the flanges 1 and 2 so that there is no risk of the user or any object getting caught on it.

On the other hand, owing to the position of the holes 12 on the folded-back lateral sections 5 and 6, the said fixing devices are perfectly accessible so that assembly can be carried out as easily as in the case of a simple conventional angle iron.

Figure 4:
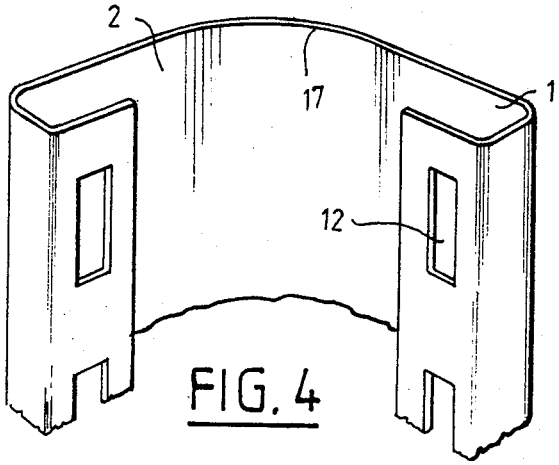

Of course, the angle formed by the flanges 1 and 2 of the angle iron 4 may vary in accordance with the applications. In certain cases, it may even be considered preferable to make this angle round as shown in FIG. 4 or to eliminate it altogether as shown in FIGS. 2 and 3. In these figures, in fact, the corner A of the angle iron shown in FIG. 1 is replaced by a flat panel 14 which joins together the flanges 1 and 2. External ribs 16 formed at the junction between the panel 14 and each of the flanges 1 and 2 increase the strength of the angle iron and allow a shaped trimming element made of plastic or similar material to be fitted, if necessary.

Figure 5:
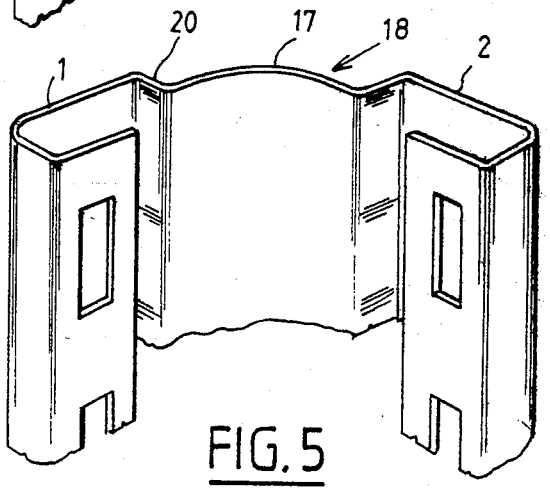

The angle iron can also be strengthened by shaping it so that it has a curved middle part offset towards the inside in relation to the flanges 1 and 2 so as to form an external recess 18 defined by the curved middle part 17 and two shoulders 20 (FIG. 5).

Figure 6:
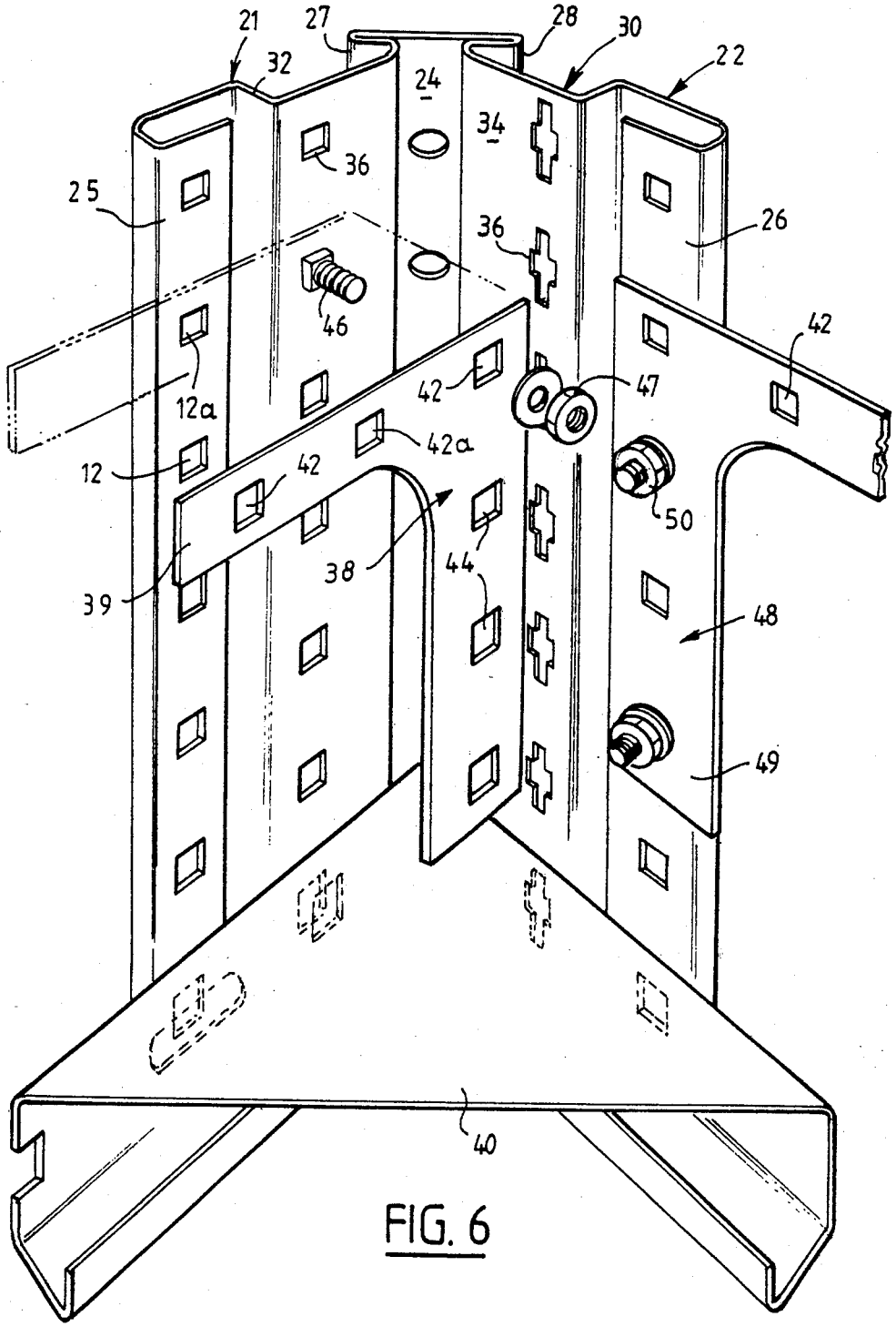
FIG. 6 is an exploded perspective view of the assembly consisting of a shaped angle iron according to the invention and different support parts.

According to a preferred embodiment shown in FIG. 6, the angle iron is shaped, for example, on a roller machine so as to have a flat middle part 24 from which two flanges 21 and 22, respectively, extend, which flanges both have a cross-section with a double bend, substantially in the form of an S, and both have at their ends inward folded sections or edge portions, 25 and 26 respectively, provided with a series of holes 12. The edges 27 and 28 opposite the sections 25 and 26 of each flange 21, 22 are bent outwards so as to lie closely against the internal surface of the flat middle panel or portion 24. Thus, each flange 21, 22 has externally a groove 30 which extends behind the plate 24 and is defined laterally, on the one hand, by the rib formed jointly by the edge 28 and the corresponding edge of the panel 24 and, on the other hand, by a shoulder 32. The bottom of this groove 30 consists of a flat surface 34 which preferably has a series of holes 36 located at intervals along its length. The holes 36 may have the same shape as the holes 12 or a different shape, as shown in FIG. 6.

Moreover, since the flat bottom 34 of the groove 30 is practically aligned with the folded-back section 25 or 26 of the corresponding flange, the holes 12 and 36 may, if required, be used to fix the same support part such as the bracket 38 or plate 40 shown in FIG. 6. One of the arms 39 of the bracket 38 has, in fact, a series of holes 42, the spacing of which corresponds to the distance which separates the holes 12 and 36 of the angle iron, while its other arm 41 has holes 44, the spacing of which corresponds to the spacing of the holes 12 or 36. This bracket 38 can therefore be fixed to the angle iron by means of fixing devices which pass through both the holes 12 and the holes 36. For example, it is fixed by means of a bolt 46 passing through a hole 36 and the hole 42 located in its corner, as well as by means of another bolt or similar device, not shown, passing through a hole 12*a* as well as the hole 42*a* next to the hole 42 through which the bolt 46 passes. Another fixing device can also be placed in one of the holes 44 and pass through the corresponding hole 36 so that the angle iron 38 is fixed more securely, while the other holes 42 or 44 are used to hold up the part to be supported, for example a shelf, plate or other object.

The bracket 38 could also be supported solely by the folded-back section 25 of the flange 21 in the same way as the bracket 48 mounted on the folded-back section 26. This bracket is, in fact, held in place by two nut and bolt arrangements 50 which pass through the holes in its vertical arm 49. The holes 42 in its horizontal arm are therefore free for mounting the parts to be supported.

It is obvious that the devices 46 or 50 for fixing the brackets 38 and 48 never give rise to dangerous projections on the outside of the angle iron. In fact, the heads of the bolts which pass through the holes 12 or 12*a* are protected by the folded-back section 25 or 26 and hidden by the unperforated part of the corresponding flange. The fixing devices which pass through the openings 36 project inside the groove 30 but over a distance which is always less than the width of the shoulder 32, so that they never extend outside this groove.

The same is true for the fixing devices, whether they be clips, hooks, bolts or other devices which ensure fixing of the plate 40 by passing in succession, through the holes in this plate and the holes 12 and/or 36 in the angle iron.

Of course, the holes 36 may have different shapes and, if necessary, may be used to attach support parts on the outside of the angle iron.

Figure 7:
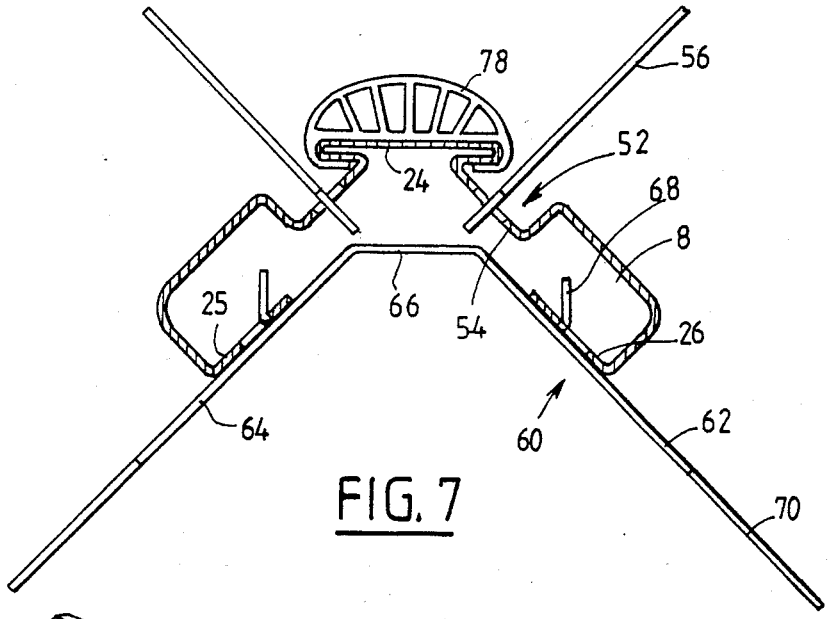
FIG. 7 is a cross-sectional view of another assembly consisting of a shaped angle iron with various support parts.
Figure 8:
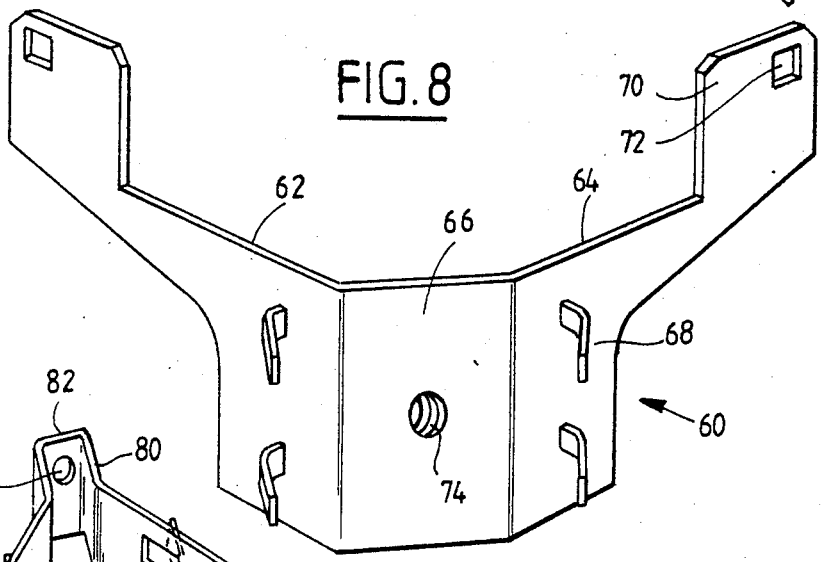
FIG. 8 is a perspective view of an angle support bracket.
Figure 10:
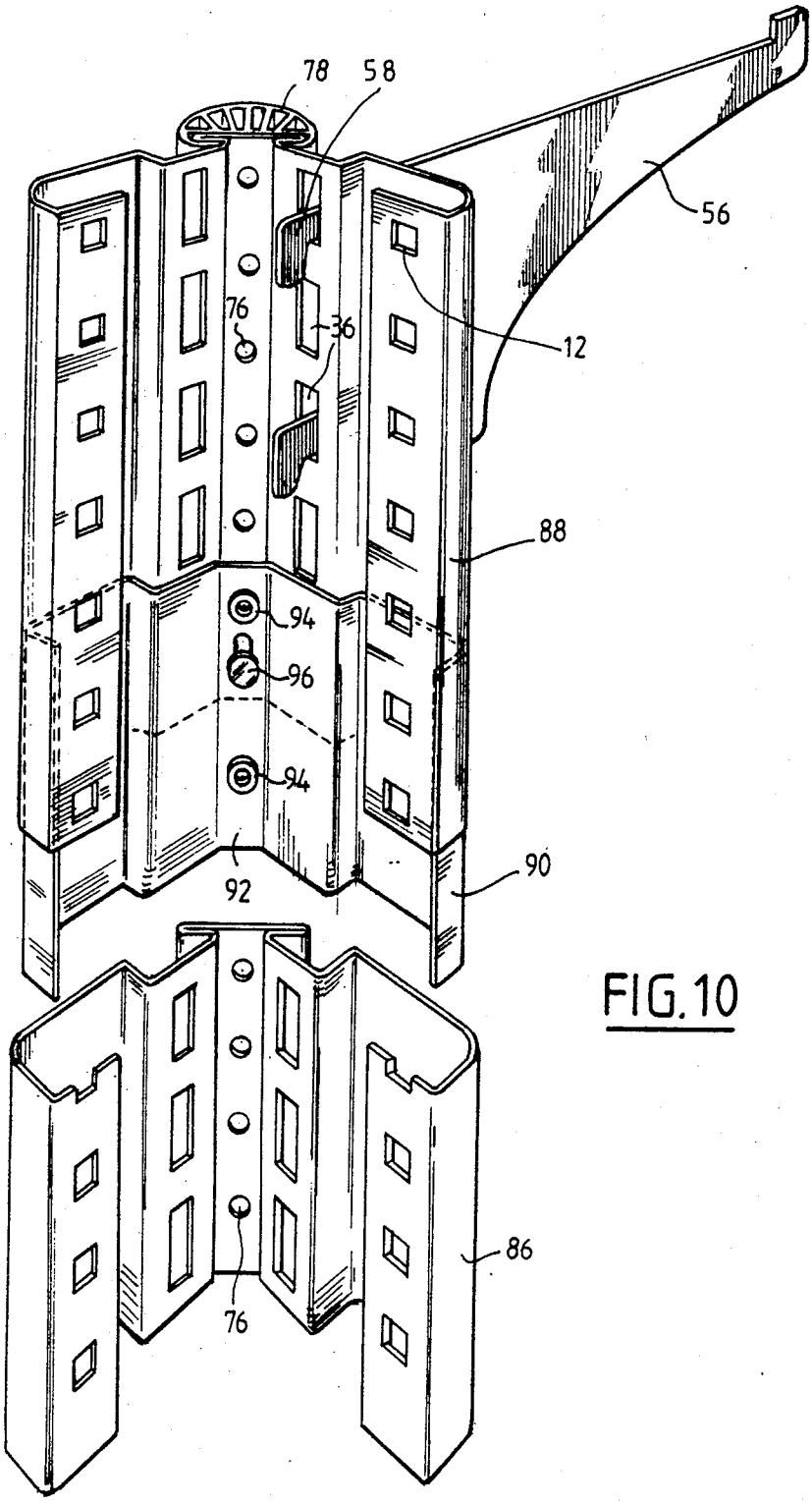
FIG. 10 is a perspective view showing several angle irons assembled end to end.

According to another variation shown more particularly in FIGS. 7 and 10, the depth of the grooves 52 formed on the outside of the angle iron is less than that of the recess 8 formed by the folded-back section 25 or 26. Consequently, the bottoms 54 of these grooves no longer lie in the extension of the folded-back sections 25 and 26, but are set back in relation to the latter, so that a free space always exists between them and the part attached to the folded-back sections 25 and 26, whether this part be a panel, a bracket, a plate or other part. The space thus left free can easily be used to accommodate the fixing end of an external part. For example, as shown in FIGS. 10 and 7, a shelf support bracket 56 provided with hooks 58 can be mounted, by means of these hooks, in two holes 36 in the bottom 54, so that it projects on the outside, whereas another part is mounted on the inside of the angle iron by means of devices passing through the holes 12 located at the same level as the hooks 58. In the embodiment shown in FIG. 7, the part assembled on the inside is an angle support bracket 60 with two diverging arms 62 and 64 connected to each other by means of a flat bottom 66. The arms 62 and 64 form between them an angle which is the same as the angle separating the folded-back sections 25 and 26 of the angle iron and they each have two external mounting lugs 68 which are substantially parallel to the plane of symmetry of the support bracket 60 and are thus capable of engaging simultaneously in the holes 12 in the two edge sections 25 and 26 when the support bracket 60 is fitted in the angle iron by means of a translational motion parallel to its plane of symmetry.

Moreover, the end of each of the arms 62 and 64 is extended at the top by a tongue 70 provided with a hole 72 and intended to fit into a corresponding slot in a plate or similar part not shown. Fixing of the support bracket 60 can be completed by means of a bolt or similar device which is screwed into a hole 74, threaded or provided with a nut, in the bottom 66 and which passes through a corresponding hole 76 in the flat panel 24 of the angle iron. The head of this bolt or a nut fixed on to the latter is covered or concealed by a trimming strip 78 which is mounted onto the panel 24 and fitted onto the side ribs which define the grooves 52.

Figure 9:
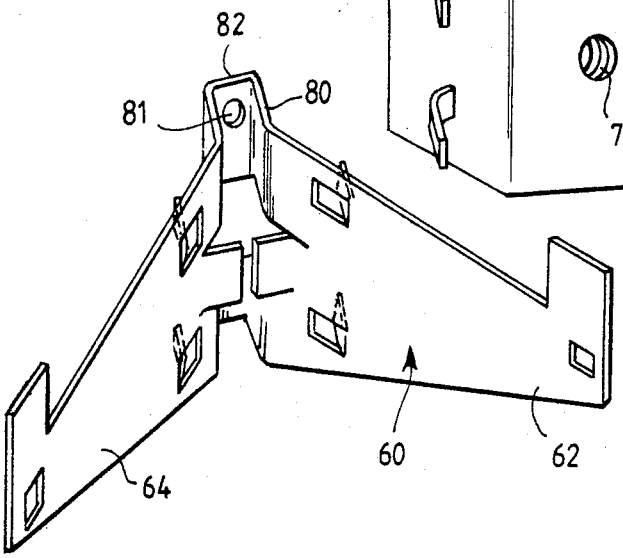
FIG. 9 is a view, similar to that shown in FIG. 8, of another angle support bracket.

According to the variation shown in FIG. 9, the arms 62 and 64 of the angle support bracket are connected to each other by a stirrup piece 80, the bottom 82 of which has a hole 81 through which a fixing device passes, the latter also passing through a hole 76 in the panel 24. The dimensions of the stirrup piece 80 are such that the bottom 82 is practically in contact with the panel 24, thereby ensuring that the assembly is fixed even more securely. Preferably, the panel 24 has holes 76 located at intervals along its length.

The angle irons according to the invention are particularly suitable for forming the vertical members or feet of a cabinet or similar object intended to support parts or tools in a workshop and intended, consequently, to be disassembled or converted, as required.

Figure 12:
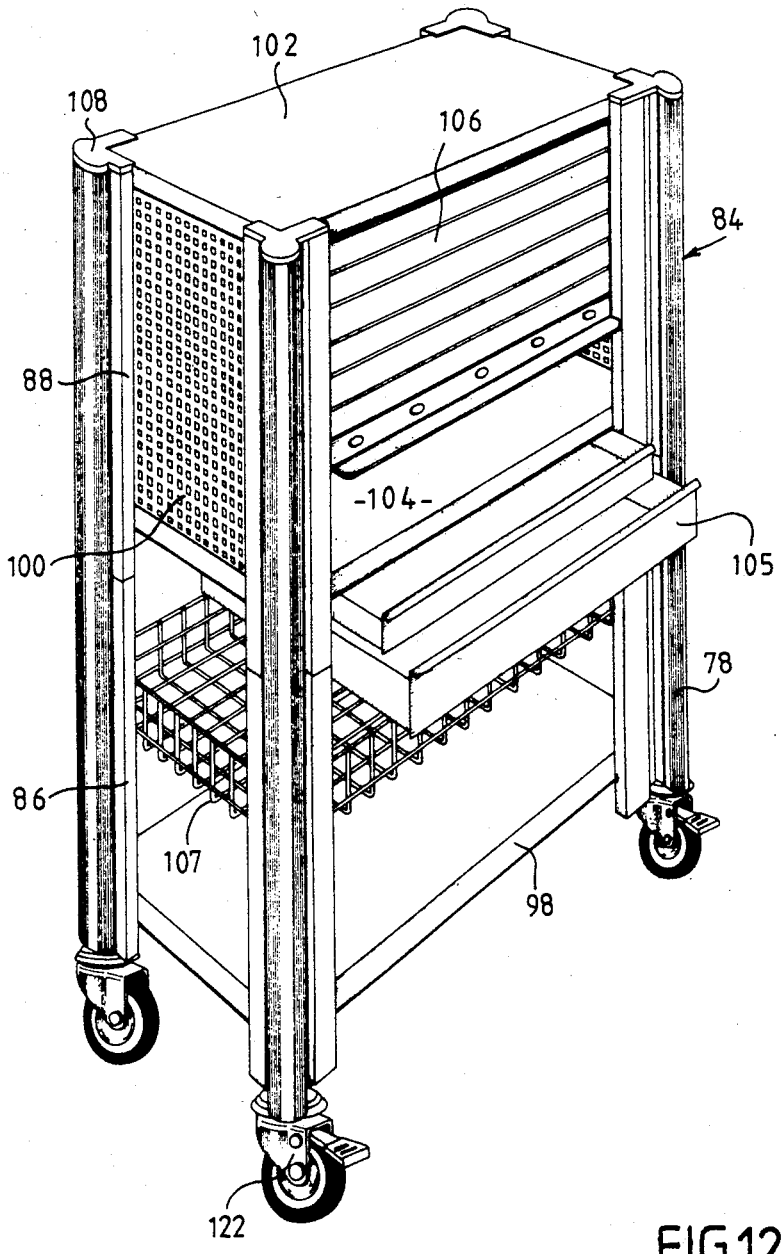
FIG. 12 is a perspective view of a storage cabinet constructed using angle irons according to the invention.

For example, the cabinet shown in FIG. 12 has four vertical members 84 which each consist of two angle irons 86, 88 arranged on top of each other so as to obtain the desired height. The angle irons 86 and 88 are assembled by means of a joining part 90 clearly shown in FIG. 10. This part consists, in fact, of a shaped piece which matches the internal surface of the angle iron and is therefore capable of fitting exactly inside tw angle irons arranged in succession. The middle part 92 of the shaped joining piece has two threaded holes 94, the spacing of which corresponds to that of the holes 76 in the panel 24 of the angle iron or preferably to a multiple of the distance separating these holes. The joining part 90 is thus fixed by means of bolts 96 on to each of the superimposed angle irons which are rigidly joined together without the holes 12 being obstructed.

The vertical members 84 are joined together at the bottom by a plate 98 mounted, for example, in the same way as the plate 40 shown in FIG. 6. The top of the cabinet is enclosed, on the one hand, by side and bottom panels 100 which have lateral holes and are mounted on the angle irons in the same way as the brackets 38 and 48 shown in FIG. 6 and, on the other hand, by an upper plate 102 and a shelf 104 which, depending on their design, are mounted directly on the angle irons or supported by angle support brackets 60. Drawers 105 can obviously be mounted underneath the shelf 104, while a closing device 106 such as a screen or similar device closes off the space defined by the side panels, the upper plate and the shelf 104. A basket 107 is also engaged in the holes in the four angle irons forming the vertical members 84. None of the fixing devices used, however, project outside the cabinet. In fact, trimmings 78 give the latter a pleasing appearance.

Figure 11:
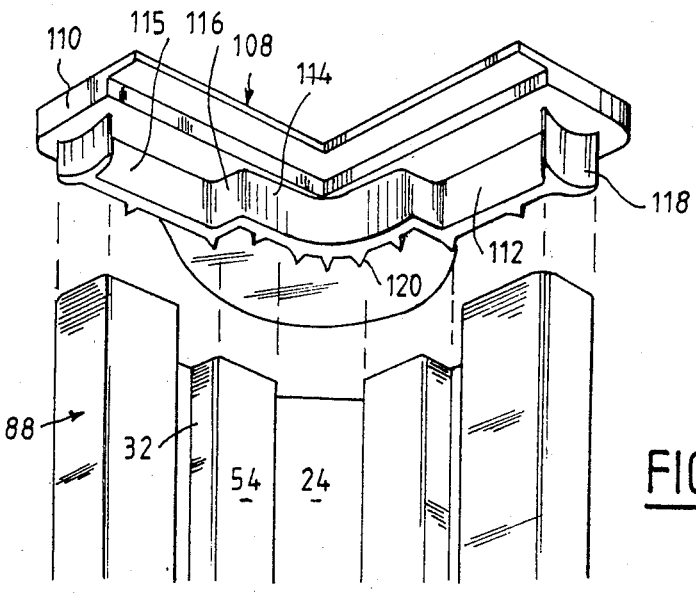
FIG. 11 is a perspective view of an endpiece for closing off the end of an angle iron, before being insertion in the latter.

At the top end of each of the vertical members 84, the angle iron is closed by an endpiece 108 fitted on to it. As is shown more particularly in FIG. 11, the endpiece 108 has a flat base 110 from which a rib 112 projects, the latter having the general shape of a V, each of the arms of which have two parts 114 and 115, respectively, which are offset and form a shoulder 116 between them. The rib 112 thus fits easily on to the shape of the angle iron, the parts 114 of the two arms resting on the walls 54 of the bottom of the grooves 52, where the parts 115 fit inside the recess 8 defined by the folded-back sections 25 and 26. Preferably, the rib 112 has, on the one hand, at each of its ends a lip 118 for locking it against the folded-back section and, on the other hand, pointed external parts 120 for engaging with the angle iron. Of course, the vertical members 84 may be sealed off at each of their ends by endpieces 108. In the embodiment shown in FIG. 12, however, the vertical members 84 have endpieces fixed at the bottom and carrying casters 122 which allow the cabinet to be moved. Of course, such endpieces could accommodate other support parts such as screw jacks or other devices.

It is obvious that the cabinet thus constructed can be disassembled at any time, the fixing devices always remaining accessible. Moreover, it can be completed, for example, by engaging brackets 56 in the holes 36 which remain accessible despite the presence of the trimmings 78. Likewise, the vertical members 84 can, at any time, be extended above the plate 102 so as to accommodate, for example, a panel for hanging tools or similar objects.

Therefore, a cabinet or similar object is obtained which has a pleasing appearance and has no projecting parts or rough edges on which people are likely to catch their clothes or injure themselves. Moveover, this cabinet can be easily assembled and can be converted and adapted at any time, as required.

I claim:

1. Angle iron for supporting plates, panels or other objects and comprising a substantially flat outer central portion having a first general plane, a first flange and a second flange extending laterally rearwardly from the central portion and having second and third general planes making an angle therebetween, a bisector plane of said angle being substantially perpendicular to said central portion, said first flange having a substantially S cross-sectional shape defining an outer groove extending alongside and adjoining an edge of said central portion and an outer rib parallel to and adjoining said groove and having a common shoulder portion with said groove, said second flange being substantially a mirror image of said first S-shaped flange, each flange having an edge portion extending laterally therefrom toward said central portion, each groove having a bottom portion intermediate said central portion and said shoulder portion which defines a series of first fixing holes spaced apart longitudinally of the angle iron and each edge portion defining a series of second fixing holes spaced apart longitudinally of the angle iron, whereby any fixing means disposed in said first holes are inwardly set back from the adjoining rib and any fixing means disposed in said second holes are externally concealed by said rib.

2. Angle iron as claimed in claim 1, wherein said bottom portion of each groove is in the same plane as said edge portion of each flange.

3. Angle iron as claimed in claim 2, wherein said bottom portion of each groove is parallel to said edge portion of each flange but outwardly offset relative to said edge portion.

4. Angle iron as claimed in claim 1, wherein a portion of each groove opposed to said shoulder is parallel to said flat central portion.

5. Angle iron as claimed in claim 1, consisting of a bent metal plate in one piece.

6. Angle iron as claimed in claim 1, wherein said flat central portion defines a series of fixing holes spaced apart longitudinally of the angle iron.

7. Cabinet for storing tools or other objects, comprising four vertical angle irons and at least one plate interconnecting the angle irons, each angle iron comprising a substantially flat outer central portion having a first general plane, a first flange and a second flange extending laterally rearwardly from the central portion and having second and third general planes making an angle therebetween, a bisector plane of said angle being substantially perpendicular to said central portion, said first flange having a substantially S cross-sectional shape defining an outer groove extending alongside and adjoining an edge of said central portion and an outer rib parallel to and adjoining said groove and having a common shoulder portion with said groove, said second flange being substantially a mirror image of said first S-shaped flange, each flange having an edge portion extending laterally therefrom toward said central portion, each groove having a bottom portion intermediate said central portion and said shoulder portion which defines a series of first fixing holes spaced apart longitudinally of the angle iron and each edge portion defining a series of second fixing holes spaced apart longitudinally of the angle iron, whereby any fixing means disposed in said first holes are inwardly set back from the adjoining rib and any fixing means disposed in said second holes are externally concealed by said rib.

8. Cabinet as claimed in claim 7, further comprising an endpiece for closing at least one end of the angle irons and including a base plate and a rib which projects from the base plate and matches an internal shape of the angle iron and fits into the latter.

9. Cabinet as claimed in claim 7, comprising a plurality of vertically aligned angle irons, a shaped joining piece interconnecting neighbouring angle irons of vertically aligned angle irons, the shape of which piece matches exactly the internal surface of each angle iron, and fixing devices extending through the joining piece and into holes provided in said flat middle portion of said angle iron.

10. Cabinet as claimed in claim 7, comprising an angle support bracket for each angle iron and having two diverging arms provided with lugs engaged in said holes in said edge portions of the respective angle iron, and at least one plate bearing on said support brackets.

11. Cabinet as claimed in claim 7, comprising external brackets engaged in said holes defined by said bottom of the groove of the respective angle iron.

12. Cabinet as claimed in claim 9, further comprising for each angle iron a trimming strip mounted on said central portion and having edge portions clipped around edges of said central portion and extending into said grooves.

* * * * *